United States Patent [19]
Schagen et al.
[11] 3,936,687
[45] Feb. 3, 1976

[54] PHOTOCATHODE WITH PLURALITY OF CONCENTRIC CONDUCTING RINGS

[75] Inventors: Pieter Schagen; Pamela May Stubberfield, both of Salfords, near Redhill, England

[73] Assignee: U.S. Philips Corporation, New York, N.Y.

[22] Filed: July 18, 1974

[21] Appl. No.: 489,578

Related U.S. Application Data

[63] Continuation of Ser. No. 395,913, Sept. 10, 1973, abandoned, which is a continuation of Ser. No. 224,923, Feb. 9, 1972, abandoned.

[30] Foreign Application Priority Data

Mar. 1, 1971 United Kingdom ..... 5655/71

[52] U.S. Cl. ..... 313/101; 250/508
[51] Int. Cl.[2] ..... H01J 39/18; H01J 39/04
[58] Field of Search ..... 313/94, 101, 102

[56] References Cited

UNITED STATES PATENTS

| | | | |
|---|---|---|---|
| 2,698,912 | 1/1955 | Teves et al. | 313/101 X |
| 2,760,077 | 8/1956 | Longini | 313/101 X |
| 3,634,713 | 1/1972 | Foote | 313/103 |

FOREIGN PATENTS OR APPLICATIONS

| | | | |
|---|---|---|---|
| 1,137,669 | 12/1968 | United Kingdom | 313/102 |

*Primary Examiner*—Robert Segal
*Attorney, Agent, or Firm*—Frank R. Trifari; Carl P. Steinhauser

[57] ABSTRACT

A flat large-area photocathode intended for use in an intensifier tube is constructed so that a predetermined potential gradient can be maintained across its surface in operation in order to simplify the electron-optical system of the intensifier. This is done by providing photoemissive material on an electrically resistive layer or sheet on a major surface of which is provided a series of spaced rings of electrically conductive material one inside the other. The spacings and widths of the rings are chosen so that, when a potential difference is applied between the center and the edge of the sheet or layer, the desired potential gradient is set up across the surface of the photocathode. The intensifier tube may be an x-ray image intensifier.

4 Claims, 3 Drawing Figures

PHOTOCATHODE WITH PLURALITY OF CONCENTRIC CONDUCTING RINGS

This application is a continuation of application Ser. No. 395,913, filed Sept. 10, 1973, now abandoned, which was a continuation of application Ser. No. 224,923, filed Feb. 9, 1972, now abandoned.

This invention relates to a photo-cathode comprising a photo-emissive layer provided on an electrically resistive substrate.

Image intensifier and converter tubes normally comprise a large-area photo-cathode for receiving electromagnetic radiation from an object and an electrostatic electron-optical system for imaging photo-electrons emitted by the photo-cathode in operation onto a cathode-luminescent screen. In order to minimise the effect of aberrations in the electron-optical system on the resulting display the photo-cathode is normally made concave towards said system. However, if this is done a further problem arises because the input radiation has to be imaged onto the photocathode and it is difficult to obtain an image of this radiation whose curvature matches that of the curved photo-cathode. The image will normally be formed in a plane. One solution to this problem is to utilise a so-called "fibre-optic plate" having one flat major face and one major face which is curved similarly to the photo-cathode. The curved face can be situated adjacent the photo-cathode and the input radiation can be imaged onto the flat face. However, this solution is an expensive one if the photo-cathode is large, as the fibre-optic plate will have to be correspondingly large. This is usually the case with X-ray image intensifier and converter tubes where the photo-cathode may be 15 or 23 cm in diameter. It is an object of the invention to provide an alternative construction which is capable of reducing the effects of aberrations in the tube electron-optical system.

It is known that the effects of such aberrations can be reduced by maintaining a potential gradient across the surface of a flat photo-cathode (the particular form of this gradient will depend upon the particular electron-optical system with which the photo-cathode is to be used). British Patent Specification No. 1137669 discloses various constructions of photo-cathode with which such a potential gradient may be obtained. In particular it discloses a circular photo-cathode wherein photo-emissive material is provided on an electrically resistive substrate, a potential difference being maintained between the centre of the substrate and its edge. The form of potential gradient required between centre and edge is obtained by varying the conductivity of the substrate in a predetermined manner over its area. This is done by suitably varying the thickness and/or composition of the resistive layer from place to place. However it is difficult to obtain a closely controlled resistance variation in this way especially when the required ratio of maximum to minimum sheet resistivity is of the order to 600 and 1, as is sometimes found in practice. It is an object of the invention to provide an alternative construction with which the desired voltage gradient can be obtained.

The invention provides a photo-cathode comprising an electrically resistive layer or sheet on a major surface of which is a series of spaced rings of electrically conductive material one inside the other, a layer of photo-emissive material being provided on and in electrical contact with said surface or on and in electrical contact with the other major surface of said resistive layer or sheet. The layer of photo-emissive material may be provided either directly on the relevant major surface or with an intermediate layer interposed. Such an intermediate layer if present may be used to convert input radiation such as X-radiation to radiation to which the photo-emissive layer is sensitive.

If a potential difference is maintained between a point on the resistive layer or sheet inside all the rings and the edge of the resistive layer or sheet the potential gradient obtained over the surface of the layer or sheet will now be modified by the presence of the rings, which will create regions of constant potential. Thus the general form of the potential gradient across the sheet or layer will be determined by the widths and spacings of the rings and can be caused to approximate closely to a predetermined law by suitably choosing these widths and spacings.

If the photo-cathode is circular the rings will normally themselves be circular and concentric.

Electric contact to the edge of the sheet or layer may be conveniently obtained by means of a said ring provided thereat. Contact to the centre may be made by means of a conductor passed through the layer or sheet and contacting a central disc of electrically conductive material provided on said major face in a manner similarly to the rings. As an alternative this central contact may be made direct to the other major surface of the sheet or layer.

The rings may be formed by aluminum vapour-deposited onto said major surface, the required pattern being obtained by a photoresist technique.

The invention will now be described with reference to the accompanying drawing in which.

Figure 1:
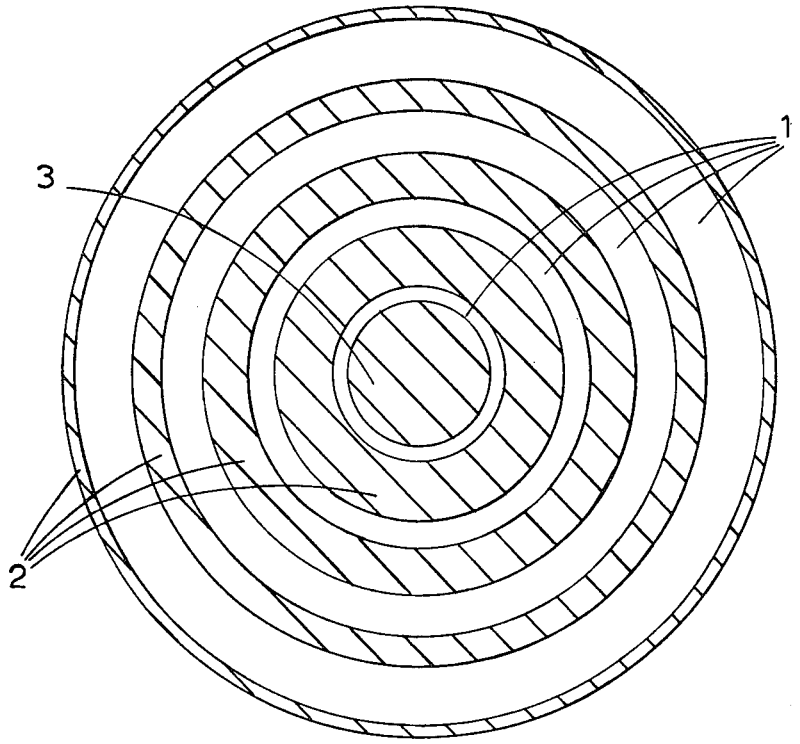
FIG. 1 shows a plan view of an X-ray photocathode substrate.

In FIG. 1 a circular photo-cathode substrate includes an electrically resistive layer or sheet 1 having a substantially constant resistivity over its surface. A series of electrically conductive concentric rings 2 are provided on a major surface of the sheet or layer 1, the widths of these rings and their spacings decreasing with increasing ring diameter. An electrically conductive disc 3 of the same material as the rings is provided at the centre of the rings.

Figure 2:
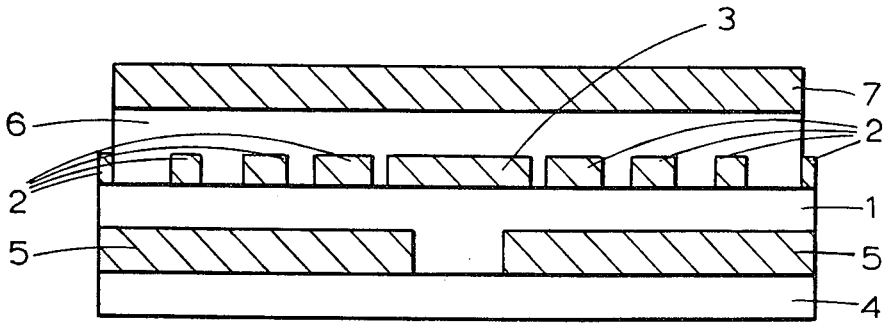
FIG. 2 shows a possible cross-section of the substrate of FIG. 1 provided with a photo-emissive layer.

FIG. 2 is a cross-section (not to scale) of one possible construction of the substrate of FIG. 1 provided with a photo-emissive layer. The substrate of FIG. 1 comprises an electrically conductive plate 4, for example of aluminum, on one surface of which is provided an electrically insulating layer 5, except for a break at the centre. The layer 5 may be provided by anodising the aluminum.

A homogenous electrically resistive layer 1, for example chromium/silicon monoxide cermet having a resistance of about $10^5$ ohms per square and about 20–25 pm thick is provided on the insulator 5 and contacts the plate 4 at its centre. On this layer 1 is provided the rings 2 and disc 3 of FIG. 1, which may be made of vapour deposited aluminum about 0.5 $\mu$ thick. An intermediate phosphor layer 6, for example of caesium iodide, is vapour-deposited onto the layer 1 together with the rings 2 and disc 3, for converting incident X-radiation into visible radiation which is capable for exciting a photo-emissive layer 7. The layer 7 is in electrical contact with the major surface of the sheet or layer 2 via the layer 6. The photo-emissive layer 7 may be a conventional photo-cathode material such as antimony-caesium vapour-deposited on the layer 6. The photocathode is incorporated in an otherwise conventional X-ray image intensifier and converter tube (not shown).

In operation a potential difference is maintained between the centre and edge of the photo-cathode assembly, contact is the edge being via the outermost of the rings 2, for example by means of a spring contact, and to the centre via the aluminum plate 4 and the gap in the insulator 5 at the centre. When used in a conventional 15 cm diameter X-ray image intensifier and converter tube a potential of +100V at the centre relative to the edge was found suitable. As has been mentioned previously, the particular form of potential gradient obtained between centre and edge can be determined at will by suitably chooning the widths and spacings of the rings 2. It is often found that a parabolic variation of potential $V$ with distance $r$ from the centre, of the form $r^2 = -4a(V-b)$, is desired where $a$ and $b$ are constants. This leads to a decreasing ring width and increasing ring spacing from centre to edge as it is shown in FIG. 1.

Figure 3:
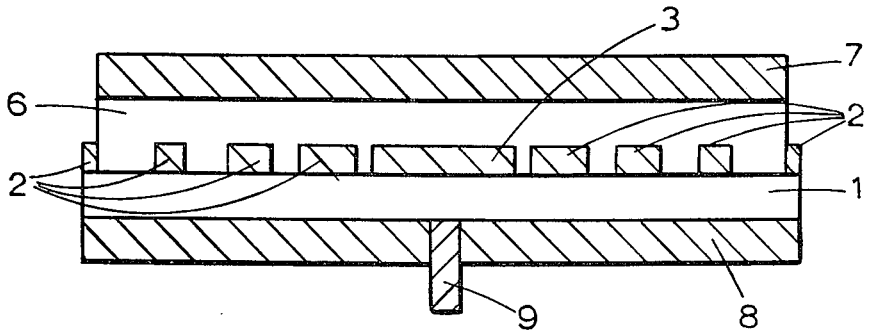
FIG. 3 shows another possible cross-section of the substrate of FIG. 1 provided with a photo-emissive layer.

The alternative cross-section of FIG. 3 differs from that of FIG. 2 in that the conductive plate 4 and insulating layer 5 have been replaced by an insulating plate 8 for example of glass, through the centre of which is sealed an electrically conductive contact pin 9. Otherwise the construction and materials may be similar to those of FIG. 2.

It will be realised that a photo-cathode assembly according to the invention may alternatively be used for receiving radiation in the visible part of the spectrum, in which case the conversion layer 6 may be omitted. It will then be necessary (if the photocathode is to operate in the transmission mode) to make the parts lying under the layer 7 of optically transparent material. For example the rings 2 and disc 3 may then be made of transparent conductive tin oxide.

As an alternative, the rings 2 may be provided between the layers 1 and 5 in FIG. 2 or between the layer 1 and the plate 8 in FIG. 3.

What we claim is:

1. A photocathode comprising a support having an insulating layer with an aperture therein, a layer of photoemissive material spaced from said insulating layer, a layer of electrically resistive material supported by said electrically insulating layer and in electrical contact with said layer of photoemissive material, a plurality of spaced, discrete, concentric electrically conductive rings and a central conductive disc within the innermost ring disposed on one surface of said layer of electrically resistive material, and means to apply a potential between the central disc and the outermost ring including a conductive member having an electrical connection to said central disc through said aperture in said insulating layer for obtaining a potential gradient across said layer of photoemissive material.

2. A photocathode as claimed in claim 1 in which said photoemissive layer is non-responsive to x-radiation and a phosphor layer for converting x-radiation to visible radiation is interposed between said photoemissive layer and said layer of electrically resistive material.

3. A photocathode as claimed in claim 1 wherein the insulating layer is provided on an electrically conductive plate, and said layer of electrically resistive material extends through said aperture in said insulating layer constituting said electrical connection to said disc.

4. A photocathode as claimed in claim 1 in which said electrical connection is provided by an electrically conductive member which extends through said aperture and contacts said electrically resistive material.

* * * * *